US012497868B2

(12) United States Patent
George

(10) Patent No.: US 12,497,868 B2
(45) Date of Patent: Dec. 16, 2025

(54) APPARATUS AND METHOD FOR STIMULATING A WELL

(71) Applicant: TORSCH INC., Calgary (CA)

(72) Inventor: Grant George, Calgary (CA)

( * ) Notice: Subject to any disclaimer, the term of this patent is extended or adjusted under 35 U.S.C. 154(b) by 493 days.

(21) Appl. No.: 17/207,157

(22) Filed: Mar. 19, 2021

(65) Prior Publication Data

US 2021/0293120 A1 Sep. 23, 2021

Related U.S. Application Data

(60) Provisional application No. 62/991,989, filed on Mar. 19, 2020.

(51) Int. Cl.

| | |
|---|---|
| ***E21B 43/12*** | (2006.01) |
| ***E21B 33/12*** | (2006.01) |
| ***E21B 43/117*** | (2006.01) |
| ***E21B 43/119*** | (2006.01) |

(52) U.S. Cl.
CPC ..... *E21B 43/117* (2013.01); *E21B 33/1208* (2013.01); *E21B 43/119* (2013.01)

(58) Field of Classification Search
CPC .. E21B 43/117; E21B 43/116; E21B 33/1208; E21B 43/119
See application file for complete search history.

(56) References Cited

U.S. PATENT DOCUMENTS

| | | | | |
|---|---|---|---|---|
| 6,647,909 | B1 | 11/2003 | Norek | |
| 7,363,967 | B2 | 4/2008 | Burris et al. | |
| 2017/0314372 | A1 | 11/2017 | Tolman et al. | |
| 2019/0284889 | A1* | 9/2019 | Lagrange | E21B 47/04 |
| 2021/0198983 | A1* | 7/2021 | Eitschberger | E21B 43/117 |

FOREIGN PATENT DOCUMENTS

| | | | |
|---|---|---|---|
| RU | 2571460 | C2 | 7/2014 |
| WO | WO2016022252 | A1 | 2/2016 |
| WO | WO2019228520 | A1 | 5/2019 |

OTHER PUBLICATIONS

Search Report—RU Application No. 2021107173/03, dated Mar. 18, 2021 (original and English translation).

* cited by examiner

*Primary Examiner* — Yong-Suk (Philip) Ro
(74) *Attorney, Agent, or Firm* — Richard D. Okimaw

(57) ABSTRACT

An apparatus for perforating a wellbore casing comprises an elongate body having a plurality of segments, each of the plurality of segments having at least one perforating shot and a control section having a casing collar locator and a controller configured to count the number of casing collars located by the casing collar locator and also configured to cause each of the plurality of perforating shots to discharge at a desired location in the wellbore casing.

17 Claims, 9 Drawing Sheets

APPARATUS AND METHOD FOR STIMULATING A WELL

BACKGROUND OF THE INVENTION

1. Field of Invention

The present invention relates generally to petroleum production and in particular to a method and apparatus for perforating a wellbore.

2. Description of Related Art

In hydrocarbon production, it is frequently desirable to select which zone of the wellbore is to be opened for production or to stimulate one or more zones of the well to increase production of that zone from time to time. One current method of stimulating a portion of the well is through the use of hydraulic fracturing or fracing. During fracing, it that is necessary to isolate all other zones and to hydraulically couple the desired zone to the interior of a production string to enable the producing string to provide fracing material to be the desired zone.

One conventional method of opening forming perforations in a casing for fracing operations is through the use of one of several methods. In particular, methods known as plug and perf utilize a bridge plug pumped down the casing with a perforating gun. The plug is set and then uses the perforating gun to pierce the casing in that zone and the zone pressurized with the fracture stimulation treatment. The process is then repeated moving up the well until complete. One difficulty with conventional plug and perf operations is that after the fracing operation is complete, the plugs must be removed, which is conventionally accomplished through milling them out. Additionally, as the bridge plug and perforating gun are lowered into the well on a wireline, the wireline must be returned to the surface for reloading which takes additional time between zones.

SUMMARY OF THE INVENTION

According to a first embodiment of the present disclosure there is disclosed an apparatus for perforating a wellbore casing comprising an elongate body having a plurality of segments, each of the plurality of segments having at least one perforating shot and a control section having a casing collar locator and a controller configured to count the number of casing collars located by the casing collar locator and also configured to cause each of the plurality of perforating shots to discharge at a desired location in the wellbore casing.

Each of the plurality of segments may include a connector therebetween. Each of the connectors may be flexible. Each of the perforating shots may be adapted to discharge after a predetermined number of collars has passed.

Each of the connectors may be releasable so as to permit separation of the plurality of segments from each other. The topmost of each of the connectors may be released after a predetermined number of collars has passed. Each of the perforating shots may be adapted to discharge after the segment is released.

Each of the segments may include at least one anchor. The at least one anchor may comprise a slidable wedge released into engagement between the shot segment and the wellbore casing. The slidable wedge may include protrusion extending into an adjacent connector.

The protrusion may extend into a separation chamber containing a burst charge capable of discharging the protrusion from the separation chamber when activated. The protrusion may be selectably retained within the separation chamber by a shear pin. The separation chamber may extend to a bore in the segment thereabove, such that activation of the separation charge causes the segment to be separated from the connector.

The elongate body may be formed of a dissolvable metal. The elongate body may include a bridge plug at a bottom end thereof. The bridge plug may be formed of a dissolvable metal. The bridge plug may be adapted to engage with the casing after passing a predetermined number of collar as measured by the casing collar locator.

According to a further embodiment, there is disclosed a method of perforating a wellbore casing comprising pumping an elongate body having a plurality of segments, each of the plurality of segments having at least one perforating shot down a wellbore and sensing at a controller in the elongate body, the passage of casing collars. The method further comprises in response to a predetermined number of collars passed, activating a separation charge between the plurality of segments so as to separate the topmost segment and engage an anchor to engage the casing and retain the segment at the desired location and causing the at least one perforating shots to discharge so as to form passages through the casing.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
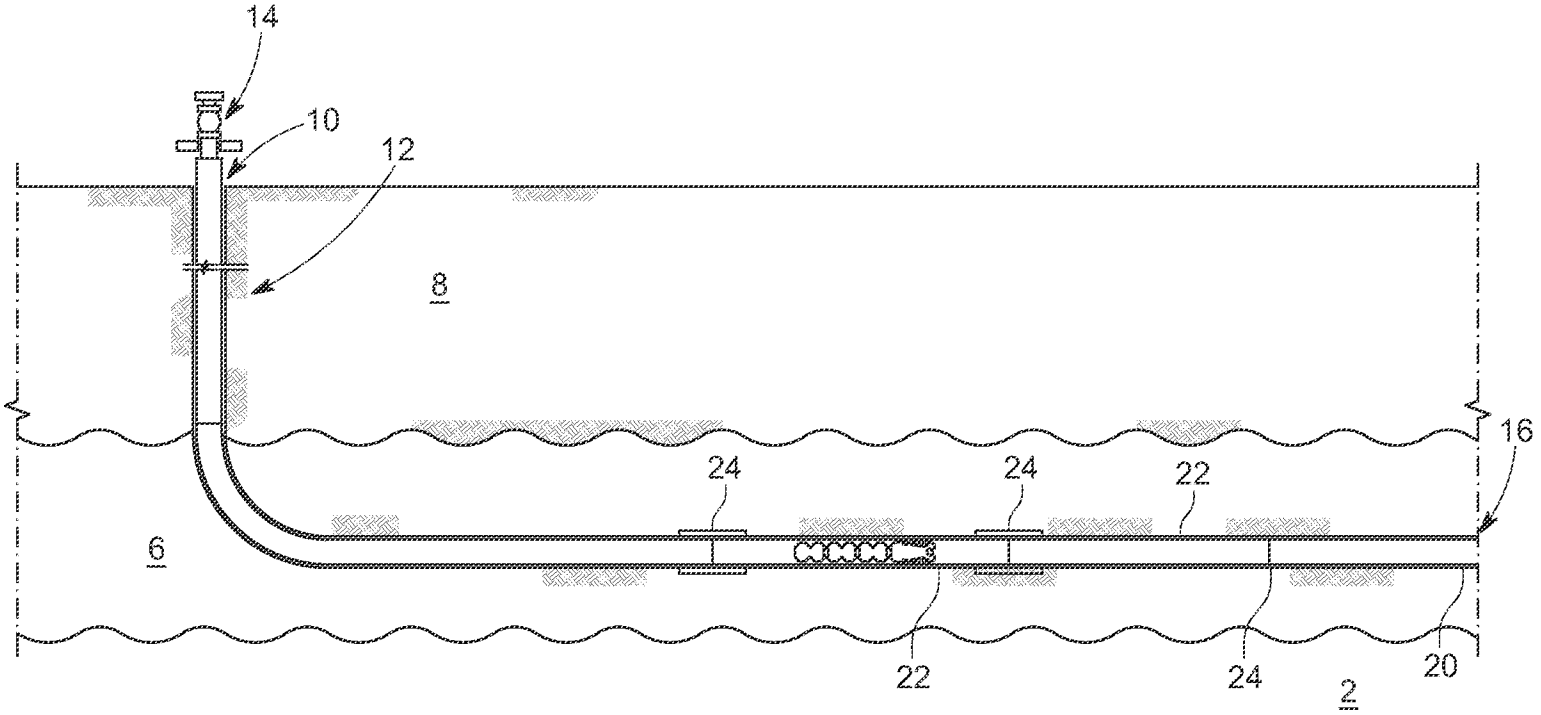
FIG. 1 is a cross-sectional view of a wellbore having a casing and a casing perforating apparatus therein.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be horizontal or angularly oriented relative to the horizontal located within the production zone 6. The casing 20 is formed of a plurality of casing 22 sections connected at collars 24 as are commonly known. After the wellbore 10 is drilled and casing 20 located therein according to known methods, the wellbore may be stimulated during a fracing operation as the operation is commonly referred to by pumping down a stimulation apparatus 30 as is further set out and described below. The apparatus 30 that perforates the wellbore at a plurality of locations before sealing the bottom of that zone for hydraulic fracturing.

Figure 2:
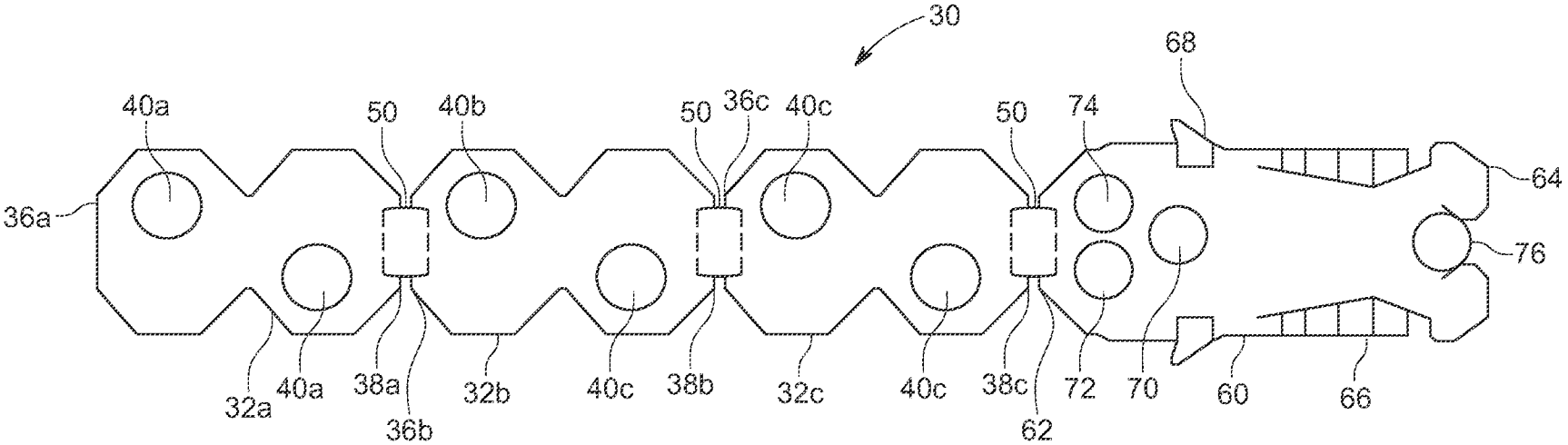
FIG. 2 is a cross-sectional view of a casing perforating apparatus of according to a first embodiment at a first position.

Turning now to FIG. 2, the apparatus 30 comprises an elongate body formed of a plurality of segments 32*a*, 32*b* and 32*c* and a plug section 60. Although three segments 32*a*-32*c* are illustrated in FIG. 2, it will be appreciated that any number of segments may be utilized. Each segment 32*a*-32*c* extends between a top end 36*a*, 36*b* and 36*c* and at bottom end 38*a*, 38*b* and 38*c*. The segments 32*a*-32*c* are lined end to end with connectors 50 located between each segment as illustrated. In in particular as illustrated in FIG. 2, the bottom end 38*a* of the first segment 32*a* is connected to the top end 36*b* of the second segment 32*b*. Subsequent segments are connected in similar manner.

Figure 5:
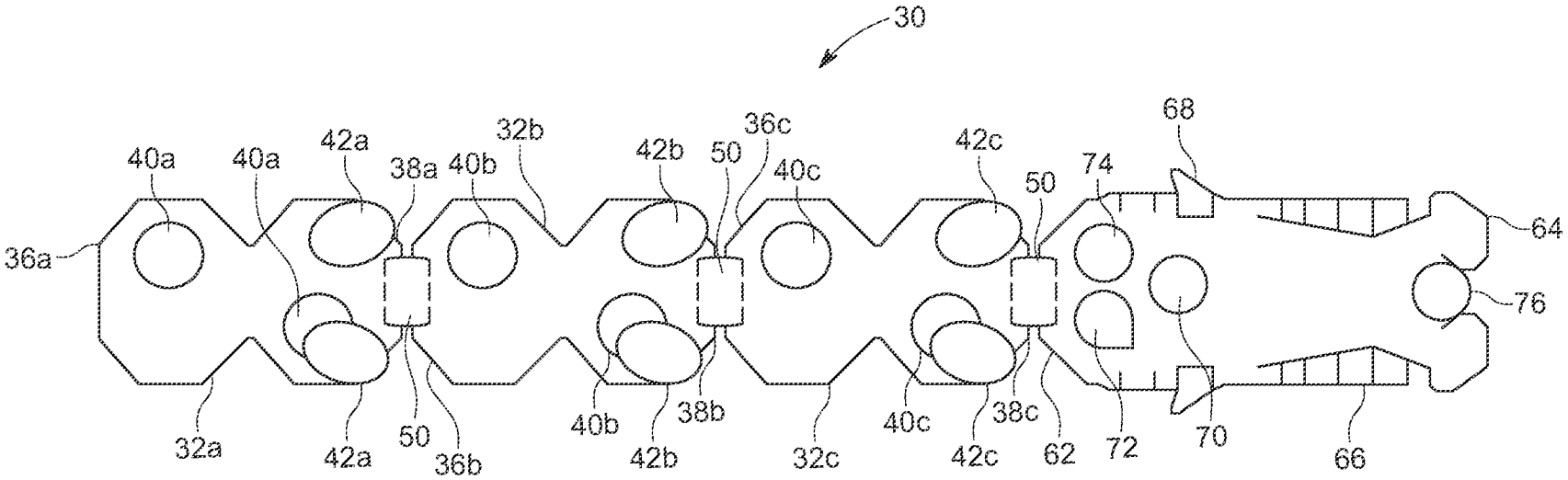
FIG. 5 is a cross-sectional view of a casing perforating apparatus according to a further embodiment at a first position.

Each segment 32*a*-32*c* includes a plurality of shots 40*a*, 40*b* and 40*c*. The shots 40*a*-40*c* are formed of a cartridge or other explosive charge adapted to perforate or puncture the casing 20 as are commonly known in the art. The shots 40*a*-40*c* are oriented towards the casing 20 at a plurality of angles as selected by a user to provide the desired perforation pattern. Although two shots 40 are illustrated, it will be appreciated that more or less may also be utilized in each segment as desired by an operator. The shots 40 may be of any conventional type as are known and currently utilized. The shots 40*a*-40*c* may be in communication with a controller 60 in the plug section 60 as will be set out further below so as to be discharged thereby forming a bore or opening in the casing 20. Optionally as illustrated in FIG. 5, each segment 32*a*-32*c* may include one or more micro swivels 42*a*, 42*b* or 42*c* adapted to rotate from the segments 32*a*-32*c* into engagement with the casing wall thereby retaining that segment 32*a*-32*c* at the desired location in the casing.

Each segment 32*a*-32*c* is connected to the preceding and subsequent segment by a connector 50. The connectors 50 may be formed of a flexible material, such as rubber or the like which permit the segments 32*a*-32*c* to swivel and/or rotate relative to each other. Optionally, the connectors 50 may include a release device (not shown) operable to cause the connector to release the connection between segments 32*a*-32*c* upon receipt of a signal from the controller 74 as will be further set out below. Optionally, the connectors 50 may be frangible so as to be ruptured or otherwise disengage the segments 32*a*-32 from each other when the swivels 42 engage the casing wall.

Figure 9:
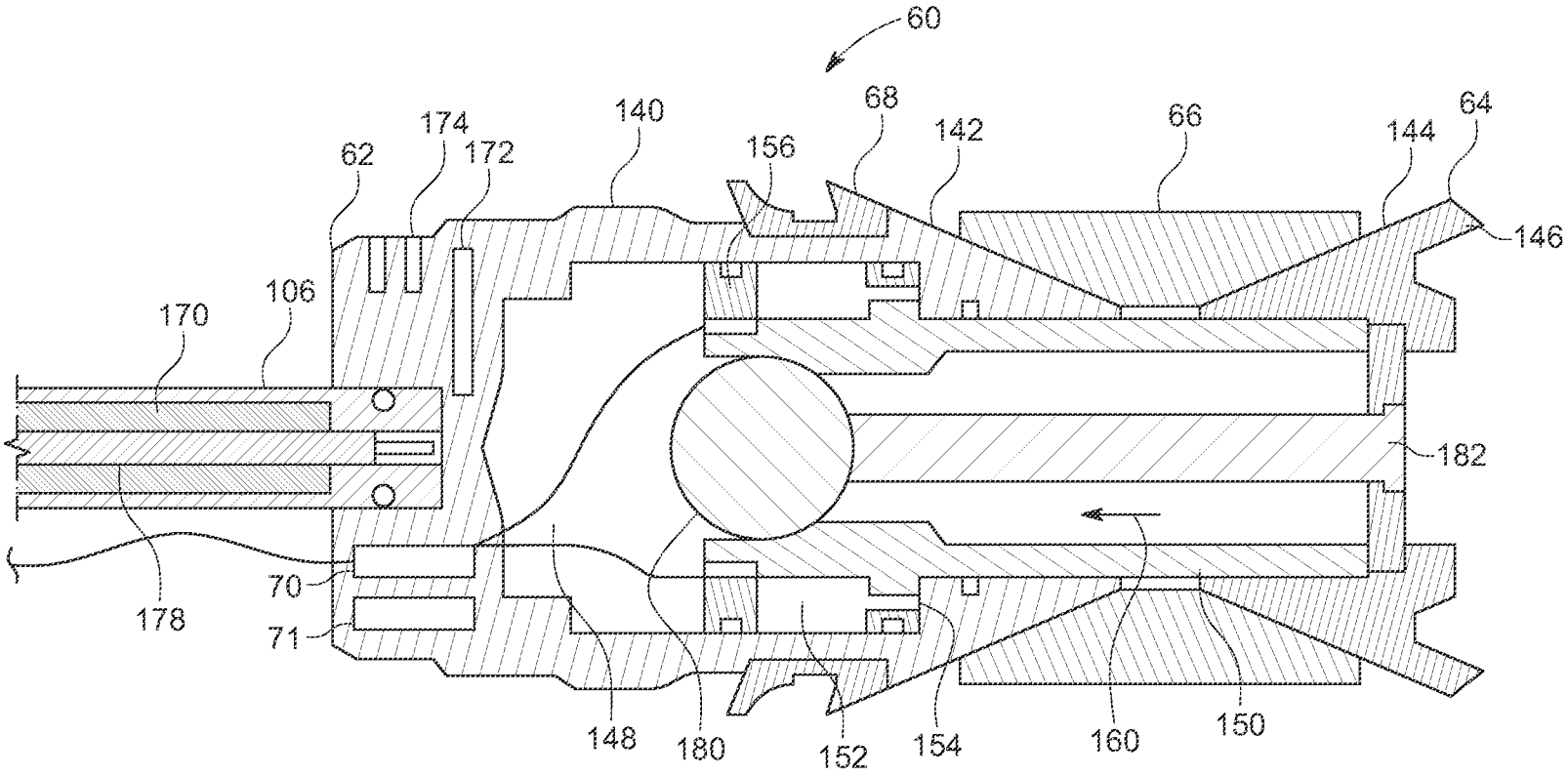
FIG. 9 is a cross-sectional view of a plug segment of a casing perforating apparatus of according to a further embodiment.

The plug section 60 extends between top and bottom ends, 62 and 64, respectively, and includes an expandable plug 66 and pump down seal 68. The plug 66 may be of any suitable type as are known in the art which may be activated into engagement with the casing 22 by a setting device 70 as is conventionally known. The pump down seal 68 is formed of a flexible annular member extending into engagement with or proximate to the casing 22 wall. The pump down seal 68 assists with the movement down the casing 22 of the apparatus under the influence of a pumped fluid as is commonly known. The pump down seal 68 may be formed of a dissolvable material. The plug section may also include a controller 72 and battery 71 as illustrated in FIG. 9 and a collar detector 74 although it will be appreciated that the controller and collar detector may also be located in a different portion of the apparatus 30 or in a separate component connected or otherwise associated therewith. The collar detector 74 comprises a sensor, such as, by way of non-limiting example, a hall effect or magnetic flux sensor configured to detect the when the apparatus passes a collar. The controller 72 is configured to receive this signal from the collar detector 74 and count the number of collars the apparatus 30 has passed. The controller is configured release the connector or optionally engage the swivels 42*a*-42*c* to release a particular segment at that location or discharge the shots at that location. In particular, the controller 72 may measure the time between collars as the apparatus 30 is pumped down the well bore. The controller may then use this averaged time to calculate the correct time to release the segment or discharge the shots so as to perforate the casing at a desired location within that section of casing. The plug segment 60 may also include a bypass valve 76 as are known. Optionally all of the segments 32*a*-32*c* and plug segment 60 may be formed of a dissolvable metal.

Figure 3:
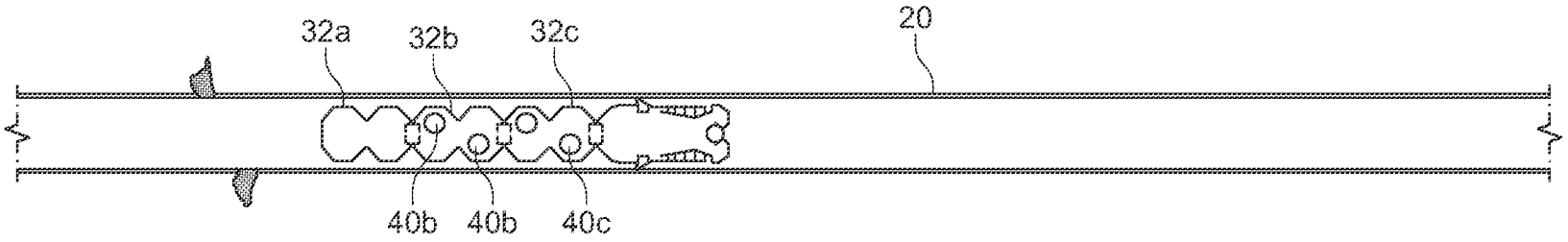
FIG. 3 is a cross-sectional view of the casing perforating apparatus of FIG. 2 at a second position.
Figure 4:
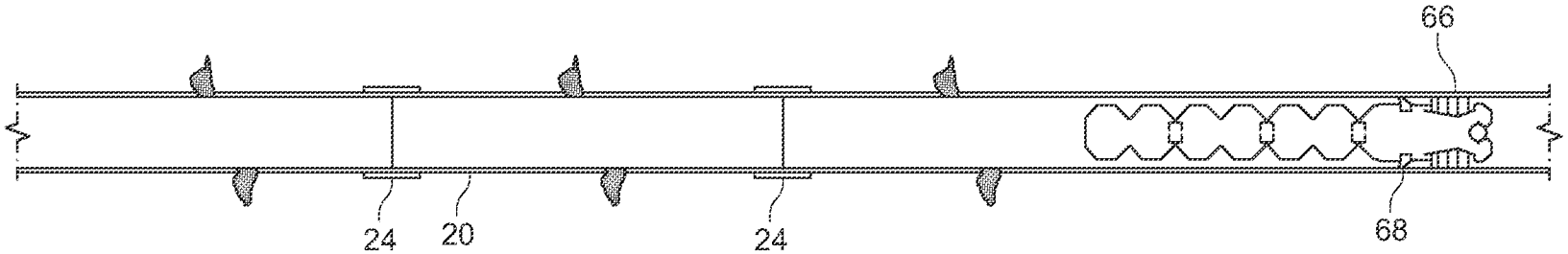
FIG. 4 is a cross-sectional view of the casing perforating apparatus of FIG. 2 at a third position.

In operation, the apparatus 30 is pumped down a casing. After a predetermined number of collars 24 have been passed as measured by the collar detector 74, the controller 72 causes the shots 40*a* in a first segment 32*a* to discharge perforating the casing 22 in that section as illustrated in FIG. 3. Subsequent segments 32*b* and 32*c* are similarly discharged to perforate the casing 22 in those subsequent locations. After the final segment 32*c* has been discharged as illustrated in FIG. 4, the setting device 70 or charge actuates the plug 66 to engage upon the casing 22 and seal the bottom of the zone. The apparatus 30 may be formed by material selected to be dissolved by the well fluid after completing of the facing operation as are known.

Figure 6:
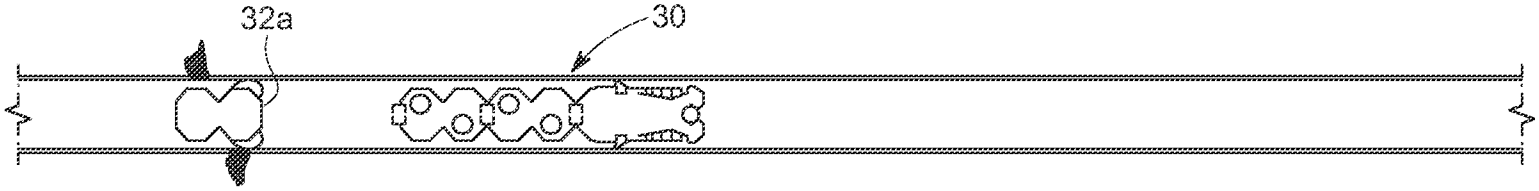
FIG. 6 is a cross-sectional view of the casing perforating apparatus of FIG. 5 at a second position.
Figure 7:
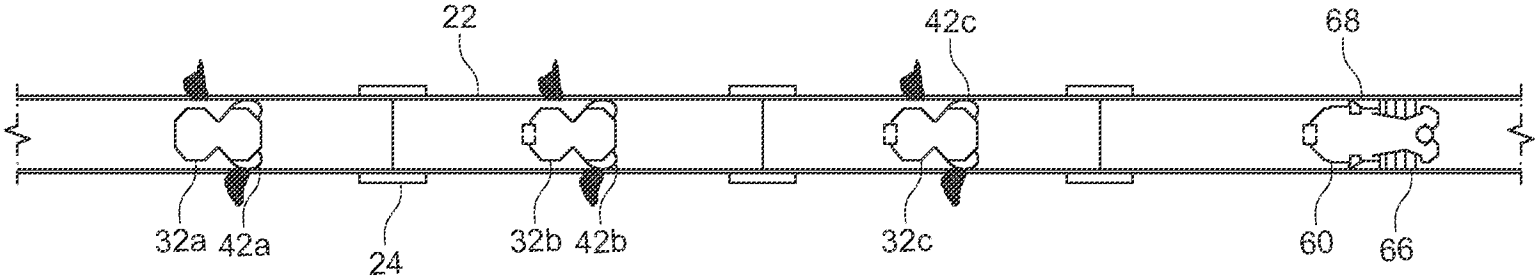
FIG. 7 is a cross-sectional view of the casing perforating apparatus of FIG. 5 at a third position.

Optionally, as illustrated in FIGS. 6 and 7, the controller 74 may release the top most segments 32*a* at each desired location by releasing the connector 50 or engaging the swivels 42 to retain that segment at the desired location. Once the final segment is at the end desired location, the plug 66 may be engaged and all shots 42*a*-42*c* fired at the same time or on a timer so as to perforate the casing. Stimulation may then be completed on that zone and the apparatus dissolved as set out above.

Figure 8:
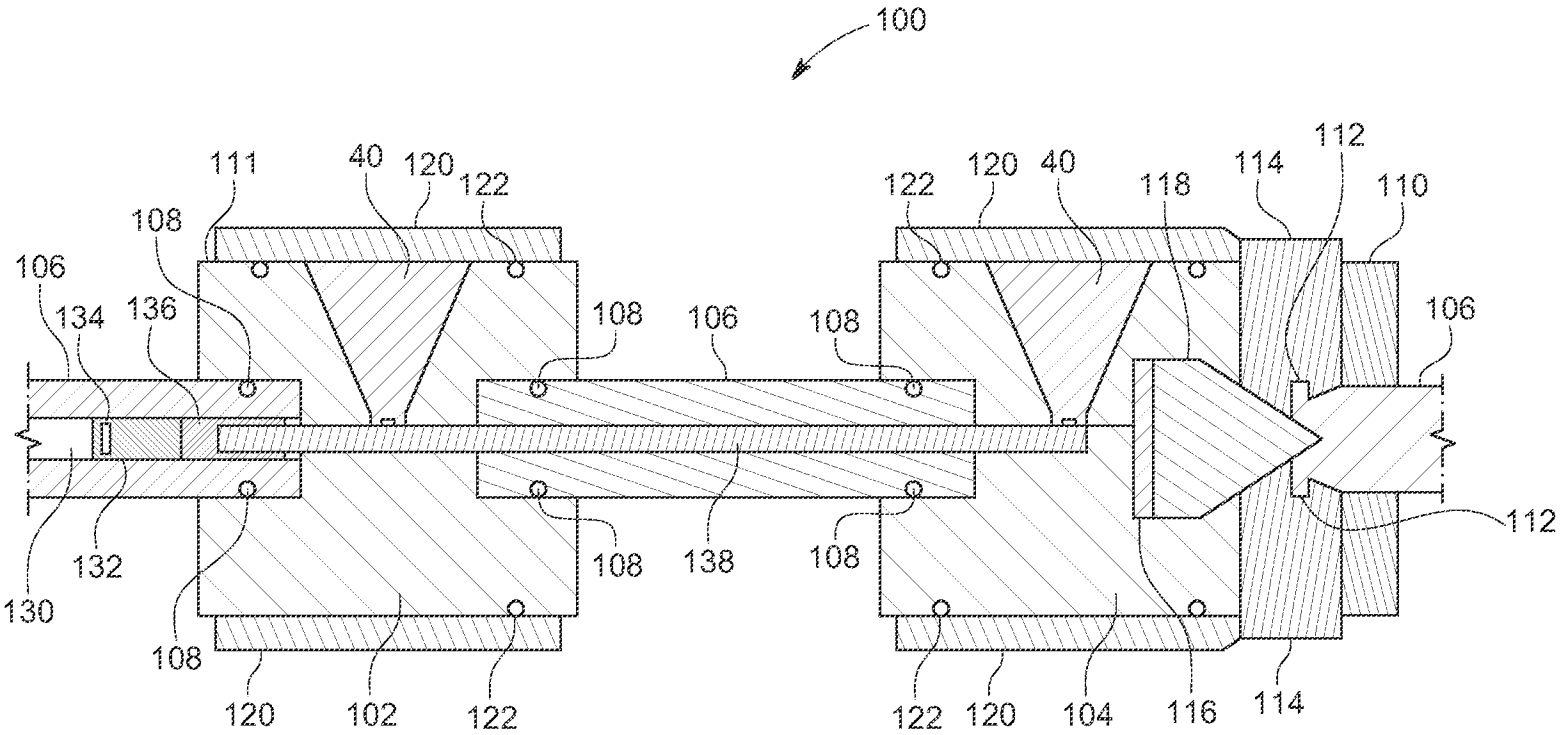
FIG. 8 is a cross-sectional view of a segment of a casing perforating apparatus according to a further embodiment.

Turning now to FIG. 8, a shot segment 100 according to a further embodiment is illustrated. As set out above, it will be appreciated that as set out above, any quantity of shot segment 100 may be utilized so as to permit the desired number of perforations as desired by a user. The shot segment 100 may be formed of first and second shot bodies, 102 and 104, respectively with a spacer 106 therebetween. As illustrated in FIG. 8, the shot segment 100 may include a spacer 106 extending from each end thereof for connection to preceding and subsequent shot segments 100 as set out above. The spacers 106 may be secured to the first and second shot bodies 102 and 104 with dowel pins 108 permitting a degree of swivel between the shot bodies 102 and 201 and the spacers 106. A bottom end 110 of the shot segment may be secured to the spacer with a pair of release pins 112 extending radially therefrom. The release pins 112 are selectively secured within a plurality of radially extendable drag pistons 114. The drag pistons 114 are slidable radially relative to the second shot body 104 so as to be movable between a retracted position as illustrated in FIG. 8 and an extended position into engagement with the casing 20. The drag pistons 114 secure the shot segment 100 at the desired position when extended. The second shot body 104 includes an electronically activated firing head 116 adapted to be discharged and expanded in response to a signal received from the controller 72. The firing head 116 acts against a wedge 118 positioned to move the drag pistons 114 apart. It will be observed that moving the drag pistons 114 apart will also disengage the release pins 112 from the drag pistons during such movement as well thereby releasing the shot section 100 from the spacer 106 at the bottom end 110 thereof.

As illustrated in FIG. 8, each of the first and second shot bodies 102 and 104 includes at least one shot 40 therein as set out above. The shot bodies 102 and 104 may include a sleeve 120 therearound so as to contain the shot 40 within a liquid sealed container and may optionally include seals 122 to improve such sealing.

The spacers 106 include a passage extending therethrough and in particular, the spacer 106 extending from a top end 111 of the shot segment 100 includes a passage 130 therethrough. When disconnected from a preceding shot segment 100, the passage is open to the interior of the well bore and in contact with the fluid therein. The passage 130 includes a pressure actuator 132 contained therein held in place by shear pins 134 or the like. As the fluid in the wellbore is pressured up, the shear pins 134 are sheared thereby permitting the pressure actuator 132 to move longitudinally in the passage 130. The passage 130 further includes a detonator 136 behind the pressure actuator 132 such that compression of the detonator by movement of the pressure actuator 132 detonates the detonator 136. The first and second shot bodies 102 and 104 and the spacer 106 therebetween include a detonating cord 138 extending thereal-ong so as to transfer the detonation from the detonator 136 to the shots 40.

Turning now to FIG. 9, a plug section 60 according to a further embodiment is illustrated. The plug section 60 includes a plug body 140 having the pump down seal 68 therearound. The plug body 140 includes a first frustoconical surface 142 at a bottom end thereof containing the seal 66 between itself and a second frustoconical surface 144 of a movable bottom cone 146. The movable bottom cone 146 is supported on an inner mandrel 150 slidably located within a cavity 148 of the plug body 140. The inner mandrel 150 includes a plurality of cavities 152 containing an expansion charge initiated by an electronic actuator 156 controlled by the controller 72. The expanded gasses produced by the expansion charge pass through a passage to an annual void 154 between the inner mandrel 150 and the plug body 140 so as to move the inner mandrel and bottom cone 146 in a direction generally indicated at 160 so as to compress the seal 66 between the first and second frustoconical surfaces. As illustrated in FIG. 9, the plug section may include a magnetic field coil sensor 170 adapted to detect the location of casing collars or an radio frequency identification (RFID) tag sensor 172 adapted to detect the location of one or more RFID tags embedded in to or located at a desired positon in the wellbore. Optionally, the plug body 140 may include one or more signalling charges 174 configured to discharge in response to a signal from the controller 72 such as in response to sensing a casing collar. Such discharges may be detected at ground level by an operator so as to assist with properly locating the shot segments 100.

The plug section 60 may include a ball 180 secured by a frangible or breakable body 182 as a bypass as is known. Furthermore, the spacer 106 extending from the top end 62 of the plug section 60 may include a detonation cord 178 therein adapted to be discharged by the controller 72 after a predetermined period of time following the frac such as by way of non-limiting example, 24 hours, so as to fragment or break up the remaining apparatus within the casing for ease of clearing.

Figure 10:
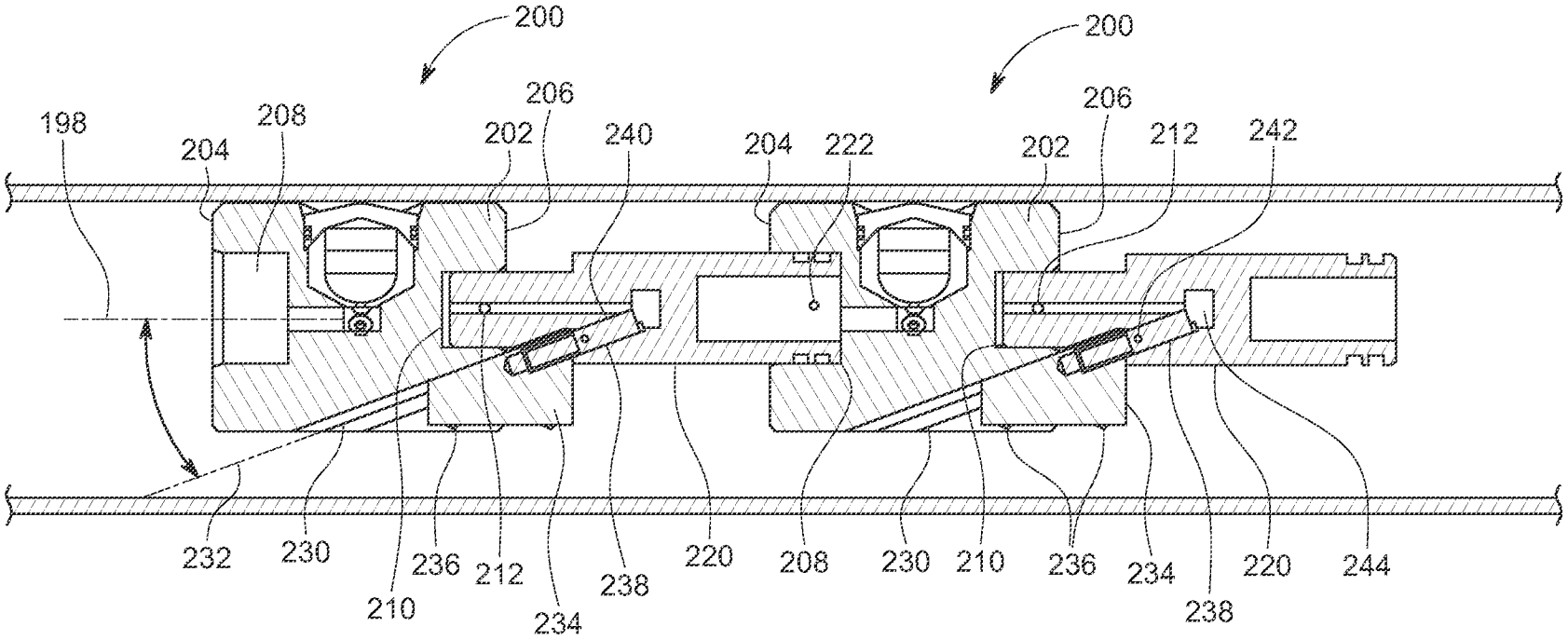
FIG. 10 is a cross-sectional view of a segment of a casing perforating apparatus according to a further embodiment.
Figure 11:
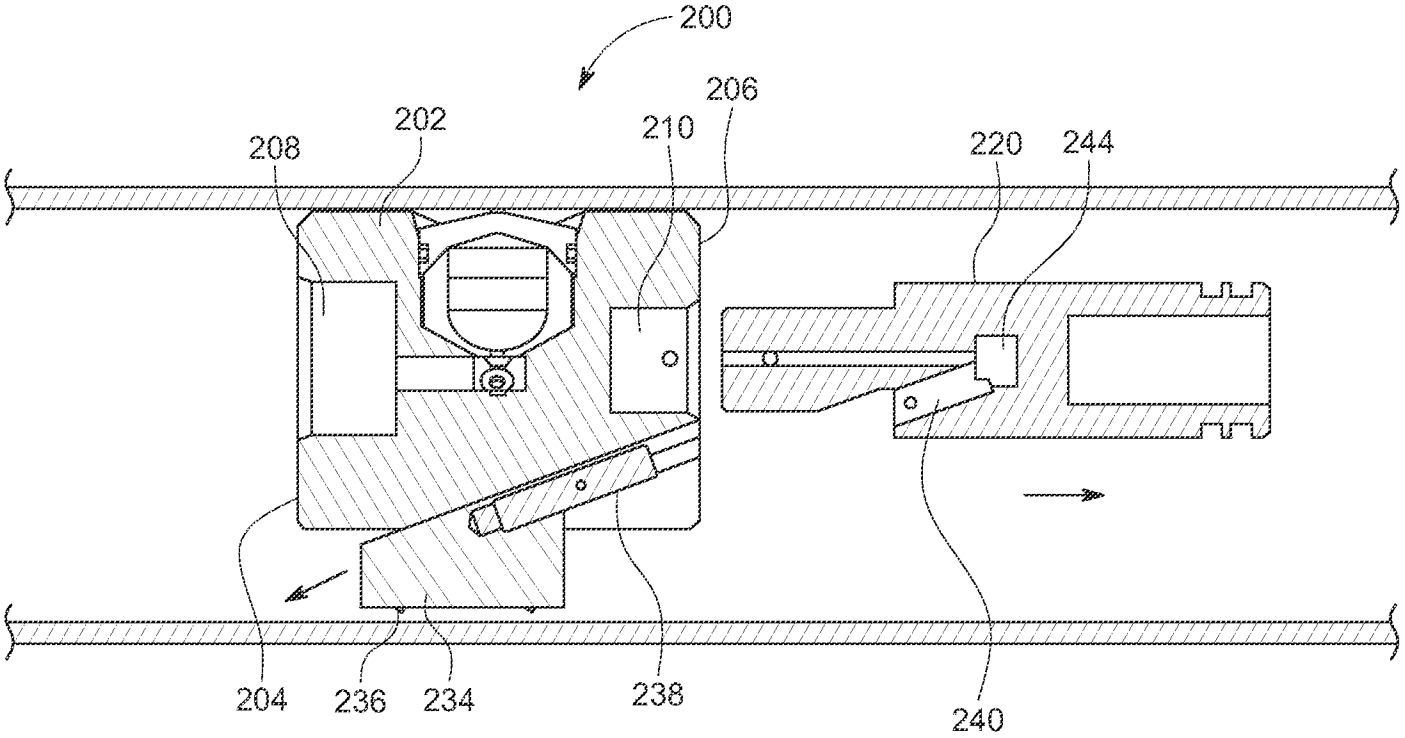
FIG. 11 is a cross-sectional view of the segment of FIG. 1 at an activated configuration.

Turning now to FIG. 10, two shot segments according to a further embodiment is illustrated generally 200. Each shot segment 200 comprises a shot body 202 with a connecting member 220 extending therebetween. The shot body 202 comprises a substantially cylindrical member extending between top and bottom ends, 204 and 206, respectively and containing a plurality of burst charges or shots 208, as set out above. The top end 204 includes a cavity 208 thereinto into which the connecting member 220 is received. As illustrated in FIGS. 10 and 11, the shot body 202 and connecting member 220 form a continuous burst charge chamber 222 adapted to contain a detonator adapted to trigger the burst charges in shots 208. The burst charge chamber 222 may also contain a battery and control system including timers for coordinating the activations of the charges in the burst charge chamber and the separation chamber 244 as set out below. The bottom end 206 includes a connecting blind bore 210 thereinto sized to receive the top end of an adjacent connecting member 220. The connecting member 220 is secured within the connecting blind bore 210 with at least one shear pin 212.

The shot body 202 includes track 230 extending angularly therefrom along an angle 232 relative to the axis 198 of the apparatus. The track 230 supports a wedge 234 therein so as to permit the wedge to be slidable along the path of the track into engagement with the wellbore. The wedge 234 may include one or more gripping members or protrusions 236 as are known in an exterior surface thereof to enhance engagement with the wellbore wall. The wedge is connected to a protrusion 238 extending into and received within an angular bore 240 in the connecting member 220. The protrusion 238 is secured within the angular bore 240 with a shear pin 242 or the like. As illustrated, the connecting member includes a separation chamber 244 containing an explosive or expansive charge as is set out above. The separation chamber 244 extends to the protrusion 238 and the blind bore 210. When the charge contained therein is activated, the shear pins 212 and 242 are sheared thereby releasing the connecting member 220 from the shot body 202 above it as well as releasing and extending the wedge 234 to slide along the track 230 and into engagement with the wellbore wall as illustrated in FIG. 11. In such a manner, the shot body 202 above that connecting member 220 is retained at that desired location for activation of the shots as set out above. The activation of the charge in the separation chamber 244 also activates the timer circuit (not shown) in the burst charge chamber 222 so as to cause the shots to form perforations through the liner after a predetermined period of the shot body 202 being set in the desired location.

While specific embodiments have been described and illustrated, such embodiments should be considered illustrative only and not as limiting the disclosure as construed in accordance with the accompanying claims.

What is claimed is:

1. An apparatus for perforating a wellbore casing comprising:

an elongate body having a plurality of segments, each of the plurality of segments having at least one perforating shot;

a control section having a casing collar locator and a controller configured to count the number of casing collars located by the casing collar locator and also configured to cause each of the plurality of perforating shots to discharge at a desired location in the wellbore casing;

a wellbore fluid isolation device at a bottom end of the elongate body operable to selectably obstruct fluid flow through the wellbore in an activated state so as to fluidically isolate a region within the wellbore above the isolation device from a region within the wellbore below the isolation device, wherein the fluid isolation device is operable be selectably extended into contact with the wellbore in an engaged configuration only in response to a signal from the control section, wherein the elongate body and isolation device are formed of material selected to be capable of disintegration.

2. The apparatus of claim 1 wherein each of the plurality of segments include a connector therebetween.

3. The apparatus of claim 2 wherein the connector is flexible.

4. The apparatus of claim 1 wherein each of the perforating shots is adapted to discharge after a predetermined number of collars has passed.

5. The apparatus of claim 1 wherein the connector is releasable so as to permit separation of the plurality of segments from each other.

6. The apparatus of claim 5 wherein the topmost of the connector is released after a predetermined number of collars has passed.

7. The apparatus of claim 5 wherein each of the perforating shots are adapted to discharge after the segment is released.

8. The apparatus of claim 5 wherein each of the segments includes at least one anchor.

9. The apparatus of claim 1 wherein the at least one anchor comprises a slidable wedge released into engagement between the shot segment and the wellbore casing.

10. The apparatus of claim 9 wherein the slidable wedge includes protrusion extending into an adjacent connector.

11. The apparatus of claim 10 wherein the protrusion extends into a separation chamber containing a burst charge capable of discharging the protrusion from the separation chamber when activated.

12. The apparatus of claim 11 wherein the protrusion is selectably retained within the separation chamber by a shear pin.

13. The apparatus of claim 11 wherein the separation chamber extends to a bore in the segment thereabove, such that activation of the separation charge causes the segment to be separated from the connector.

14. The apparatus of claim 1 wherein the elongate body is formed of a dissolvable metal.

15. The apparatus of claim 1 wherein the isolation device comprises a bridge plug at a bottom end thereof.

16. The apparatus of claim 1 wherein the isolation device is adapted to engage with the casing after passing a predetermined number of collar as measured by the casing collar locator.

17. An apparatus for perforating a wellbore casing comprising:

an elongate body having a plurality of segments, each of the plurality of segments having at least one perforating shot;

a control section having a casing collar locator and a controller configured to count the number of casing collars located by the casing collar locator and also configured to cause each of the plurality of perforating shots to discharge at a desired location in the wellbore casing;

a wellbore isolation device at a bottom end of the elongate body operable to selectably obstruct fluid flow through the wellbore in an activated state so as to fluidically isolate a region within the wellbore above the isolation device from a region within the wellbore below the isolation device, wherein the elongate body and isolation device are formed of material selected to be capable of disintegration;

a releasable connector between each of the plurality of segments;

an anchor included with each of the plurality of segments; and a burst charge capable of releasing the release connector and engaging the anchor when activated.

* * * * *